US005346205A

United States Patent [19]

Lawrence

[11] Patent Number: 5,346,205

[45] Date of Patent: Sep. 13, 1994

[54] SORTER HAVING PIVOTABLE DIVERTER GATES WITH NIP ROLLERS AND DIVERTER MODULE ASSEMBLY THEREFOR

[75] Inventor: Frederick J. Lawrence, Tustin, Calif.

[73] Assignee: Gradco (Japan) Ltd., Tokyo, Japan

[21] Appl. No.: 72,028

[22] Filed: Jun. 7, 1993

[51] Int. Cl.[5] ..... B65H 39/10

[52] U.S. Cl. ..... 271/297; 271/302; 271/305

[58] Field of Search ..... 271/297, 302, 303, 305

[56] References Cited

U.S. PATENT DOCUMENTS

| | | | |
|---|---|---|---|
| 4,428,572 | 1/1984 | Burke | 271/305 X |
| 4,691,914 | 9/1987 | Lawrence | 271/297 |
| 4,819,931 | 4/1989 | Goto et al. | 271/297 X |
| 5,201,518 | 4/1993 | Isoda | 271/297 X |

FOREIGN PATENT DOCUMENTS

| | | | |
|---|---|---|---|
| 48151 | 4/1980 | Japan | 271/297 |

*Primary Examiner*—Robert P. Olszewski
*Assistant Examiner*—Boris Milef
*Attorney, Agent, or Firm*—Newton H. Lee, Jr.

[57] ABSTRACT

A random access mailbox has a stack of horizontally extended trays for receiving sheets of paper supplied from a printer. A modular construction provides a sheet transport system including gates to deflect sheets into a selected tray from sheet feeding rollers incorporated in the modules for carrying sheets through a sheet path defined between the rollers and pressure applying rollers to the respective gates which can be actuated randomly to deflect a sheet from the rollers into a selected tray between cooperative modules. A sheet detector is provided at each gate along the feed path to detect the presence of a sheet at any location along the feed path. The gates or deflectors nest or overlap vertically to reduce overall height of the apparatus and provide continuity to the sheet guide surfaces.

11 Claims, 8 Drawing Sheets

SORTER HAVING PIVOTABLE DIVERTER GATES WITH NIP ROLLERS AND DIVERTER MODULE ASSEMBLY THEREFOR

BACKGROUND OF THE INVENTION

In the use of computer controlled printers it has become desirable that the output from the printer be collected in sorter trays to separate multiple copies of a job. In addition, particularly in the case of networked printers, it has become desirable to be able to separately collect different jobs in the sorter trays in the manner of a mailbox, so that the jobs or work output for different users may be isolated from one another.

It also has become desirable that the separate jobs which may be of a sensitive nature may be secured against unauthorized access, so that locking mailbox type sorter constructions have evolved.

Printers which operate at relatively high speeds of, say, 40 pages per minute are faster and generally with small gaps between pages or between the last page of one job and the first page of another job, may require truly, almost instantaneous, random access to different trays. Sheet sorting or collating machines of the type using instantaneously and selectively operable means for deflecting sheets from the sorter sheet transport to the selected trays are preferably employed for such high speed printers.

Examples of such sorters are shown and described, for example, in my prior U.S. Pat. Nos. 3,937,459 and 4,691,914.

In the case of U.S. Pat. No. 3,937,459, a series of vertically spaced gates are arranged to be actuated by solenoids to deflect sheets from a vacuum plenum type transport, into the trays which are arranged in a vertical stack. The only speed limitation on such a sorter and other so-called fixed bin, gate type sorters is the time required for the gates to move from a normal sheet guiding position to a sheet deflecting position, so that such sorters are very well suited to use as true random access mailboxes, as referred to above. In addition, the gates are of nesting construction to reduce the overall height of the apparatus while providing a guide for sheets passing the gates.

In the case of U.S. Pat. No. 4,691,914, the sheet path is defined by opposing sets of rollers carried by a modular stack of sheet transport units, and a solenoid operated nip roller is moved to a position cooperative with one of the fixed rollers to divert or deflect a sheet into a selected tray. Such a sorter construction is more simple in construction than the sorter of U.S. Pat. No. 3,937,459 and lends itself to selecting the number of trays and the height of the assembly due to its modular construction. Again, such a sorter is applicable to relative high speed printers because it can be randomly operated substantially instantaneously.

Another prior sorter useful with high speed printers is shown in U.S. Pat. No. 4,881,730. In this construction the sorter employs a combination of sheet transport rollers and pivoted gates to deflect sheets from the transport rolls to the trays.

As shown in U.S. Pat. No. 4,111,410 vertically spaced sets of feed rollers transport the sheets to the tray entry space and gates are opened to deflect sheets from the rollers, while the sheet inlet ends of the trays are held spaced apart to increase the inlet space.

These types of sorters referred to above are inherently expensive, due to the numbers of components and the size of the sorter assemblies required to sort or collate the output of sheets from a source machine, either sequentially or randomly. However, such sorters are fast because they eliminate the time delays inherent in sorter devices of the types employing travelling infeeds, as exemplified in my U.S. Pat. No. 4,843,434 or travelling deflectors, as exemplified in Snellman U.S. Pat. No. 3,372,922, dated Mar. 12, 1968, or travelling sheet gripping infeeds, as exemplified in U.S. Pat. No. 4,881,730, or the lockbox sorter disclosed in the application of Coombs and Billings, U.S. Ser. No. 849,233 (owned in common herewith) in which the gates are selectively operable by an indexed actuator which also can release a lockbox. These latter types of sorter devices are not as well suited for high speed printer mailboxes because of the time delay required to provide for transfer of a sheet to different bins.

SUMMARY OF THE INVENTION

The present invention relates to a random access sorter or mailbox which utilizes certain features of my above referenced U.S. Pat. Nos. 3,937,459 and 4,691,914 and U.S. Pat. No. 4,111,410 and other features in such a way as to provide a novel sorter mailbox.

More particularly, the present invention utilizes a combination of the pivoted gate devices of my U.S. Pat. No. 3,937,459 and 4,111,410, together with modular features of my U.S. Pat. No. 4,691,914 in a structure in which the efficiency with which sheets are fed into the trays is enhanced.

In my present construction the sheet feeding and deflector units or modules are constructed such that the nip roller in each module cooperates with a driven roller in the next adjacent module and the nip rollers shift when the deflector gate is actuated to direct a sheet into the tray to provide a correct sheet trajectory relative to an upward incline of the tray to minimize the impact of the leading edge of successive sheets with a preceding sheet. The relationship of the feed roller and nip roller also cause enhanced movement of sheets into the trays by gripping the sheet until the sheet has been fed substantially into the tray.

The present structure combines the infeed drive and nip roller modular assembly in a compact structure enabled by the use of deflecting gates which overlap or nest, as taught in my U.S. Pat. No. 4,937,459 and U.S. Pat. No. 4,111,410.

The present invention has other features and advantages which will be hereinafter described or will become apparent from the following detailed description with reference to the accompanying drawings forming a part hereof.

DESCRIPTION OF THE PREFERRED EMBODIMENT

Figure 1:
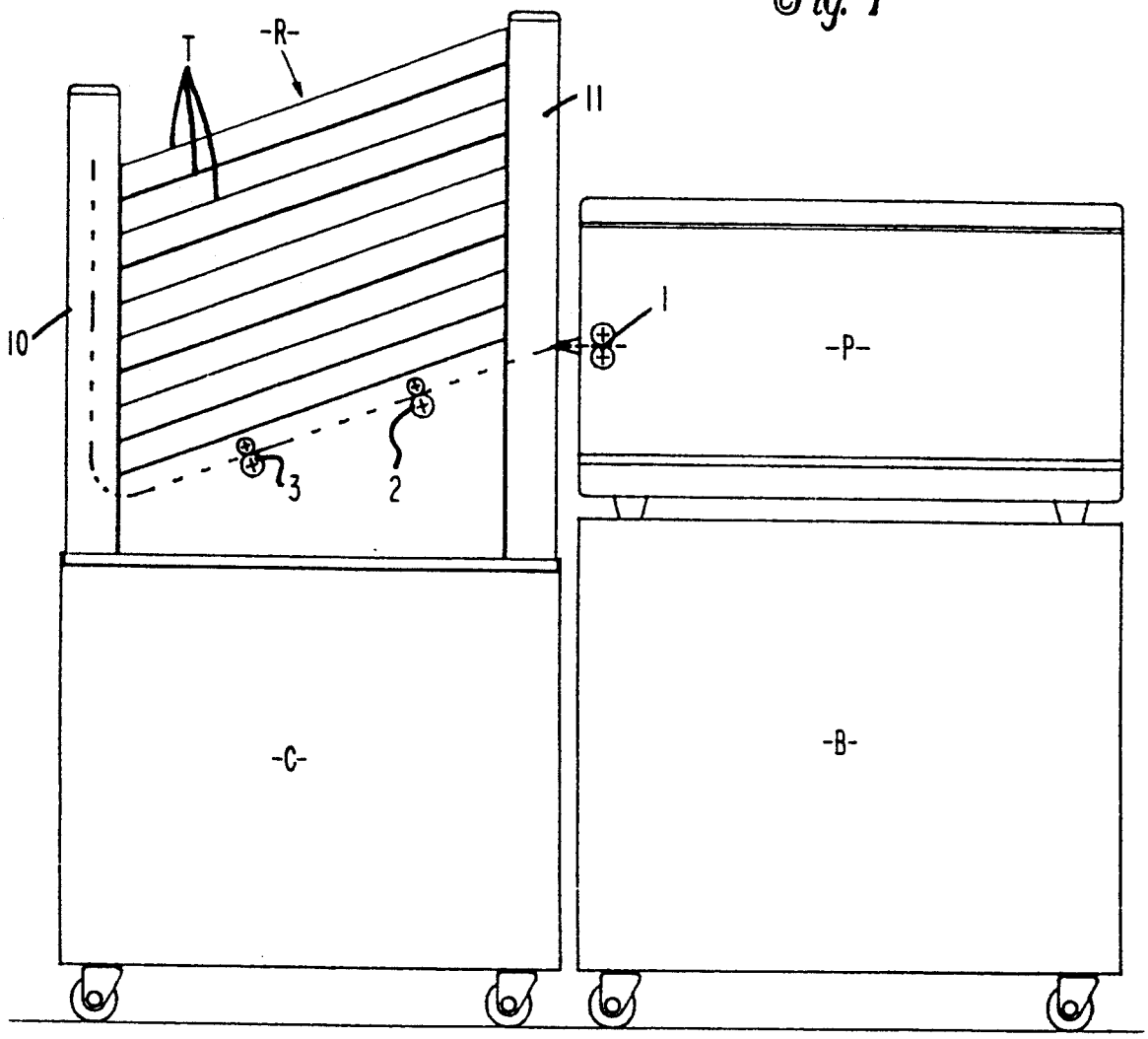
FIG. 1 is a side elevation showing a printer and associated sorter in accordance with the invention.
Figure 2:
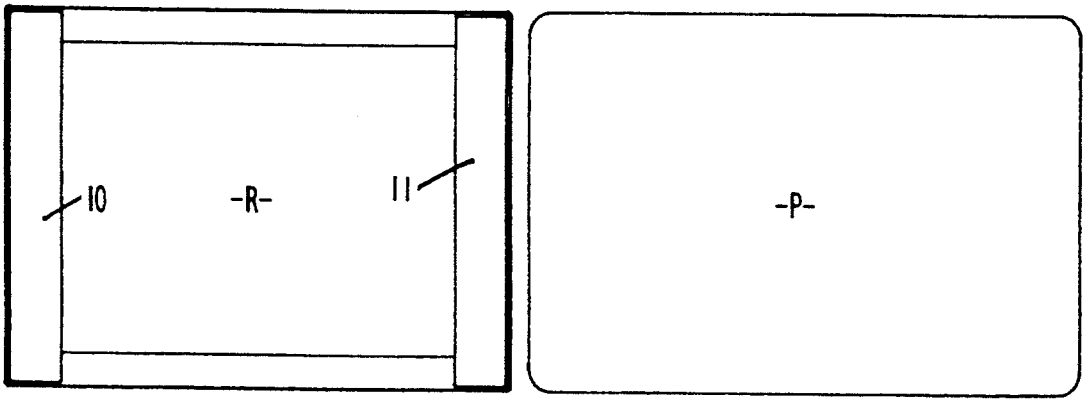
FIG. 2 is a top plan thereof.
Figure 3:
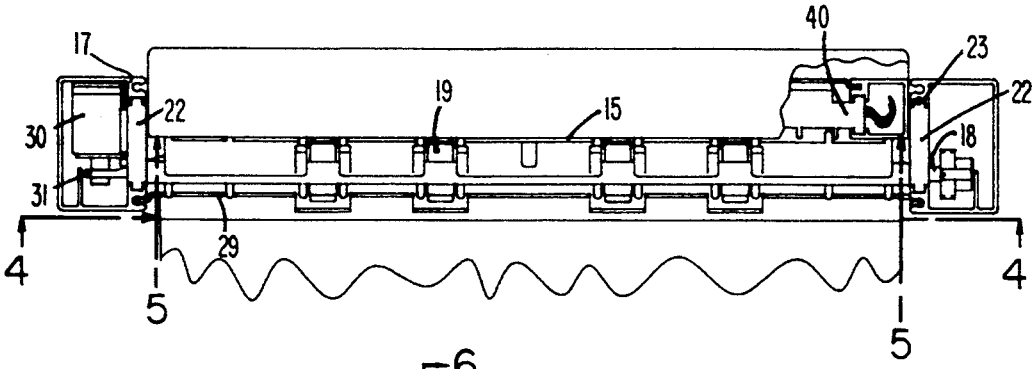
FIG. 3 is a horizontal section on the line 3—3 of FIG. 1.

In the embodiment illustrated in FIGS. 1–16 referring first to FIGS. 1–3, an office printer or copier P is mounted on a suitable base B and is adapted to supply printed sheets to a sheet receiver R also mounted on a suitable base or cabinet C.

The printer B is adapted to supply sheets by output rolls 1 to a transport in the bottom of the receiver including suitable feed rolls 2 and 3 so that sheets are fed in the path indicated by the broken line which turns upwardly for delivery of the sheets to the respective trays T, as will be later described, by the sheet transporting and deflecting and tray support tower assembly 10 and a tray support 11. The trays T extend horizontally at an incline from the tower 10 to support 11.

As seen in FIGS. 3–8 the tower 10 comprises a sheet transport and deflecting system including a transport deflecting section 12 and a pressure applying and sheet detecting section 13 which is pivoted at 14 to enable the assemblies 12 and 13 to be separated at a sheet feed path 15 extending vertically between these two components.

Figure 6:
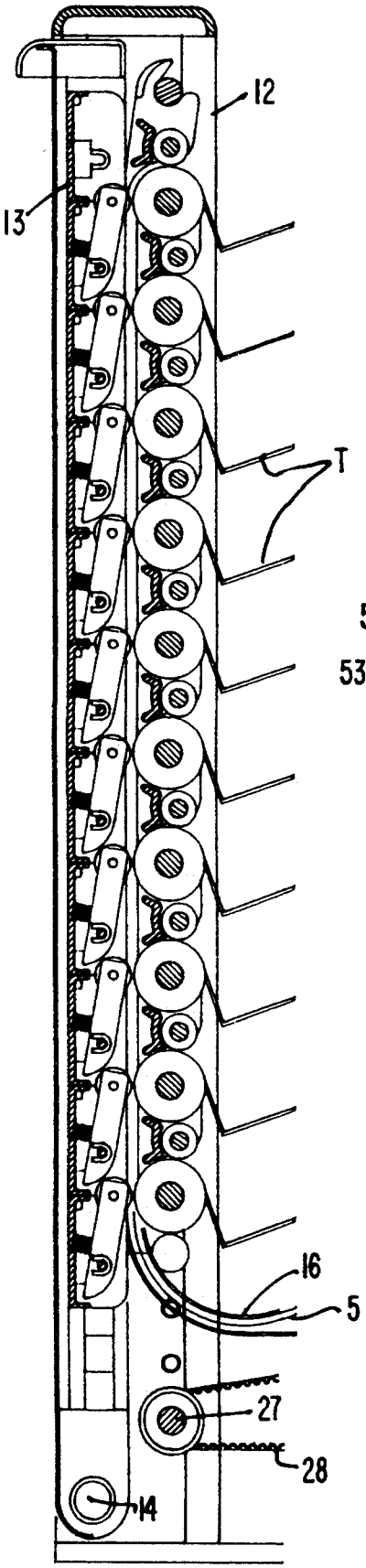
FIG. 6 is a vertical section on the line 6—6 of FIG. 4.
Figure 7:
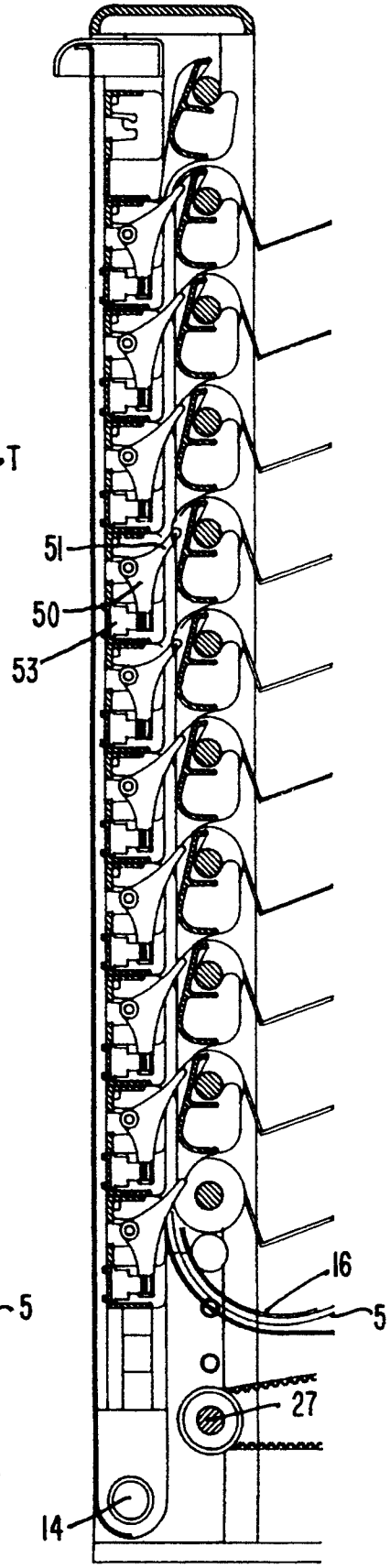
FIG. 7 is a vertical section on the line 7—7 of FIG. 4.

In the feed path 15 the sheets of paper S, as seen in FIGS. 6 and 7 are adapted to be fed upwardly from the paper transport 2 and 3 via a guide 16, for ultimate delivery to the trays T, either in sequence as in the usual collation of successive copies of the pages of a document being copied, in a book mode as in the collection of copies of a multiple page document supplied from the printer, or randomly, in the case that the apparatus is to be employed as a mailbox.

Figure 4:
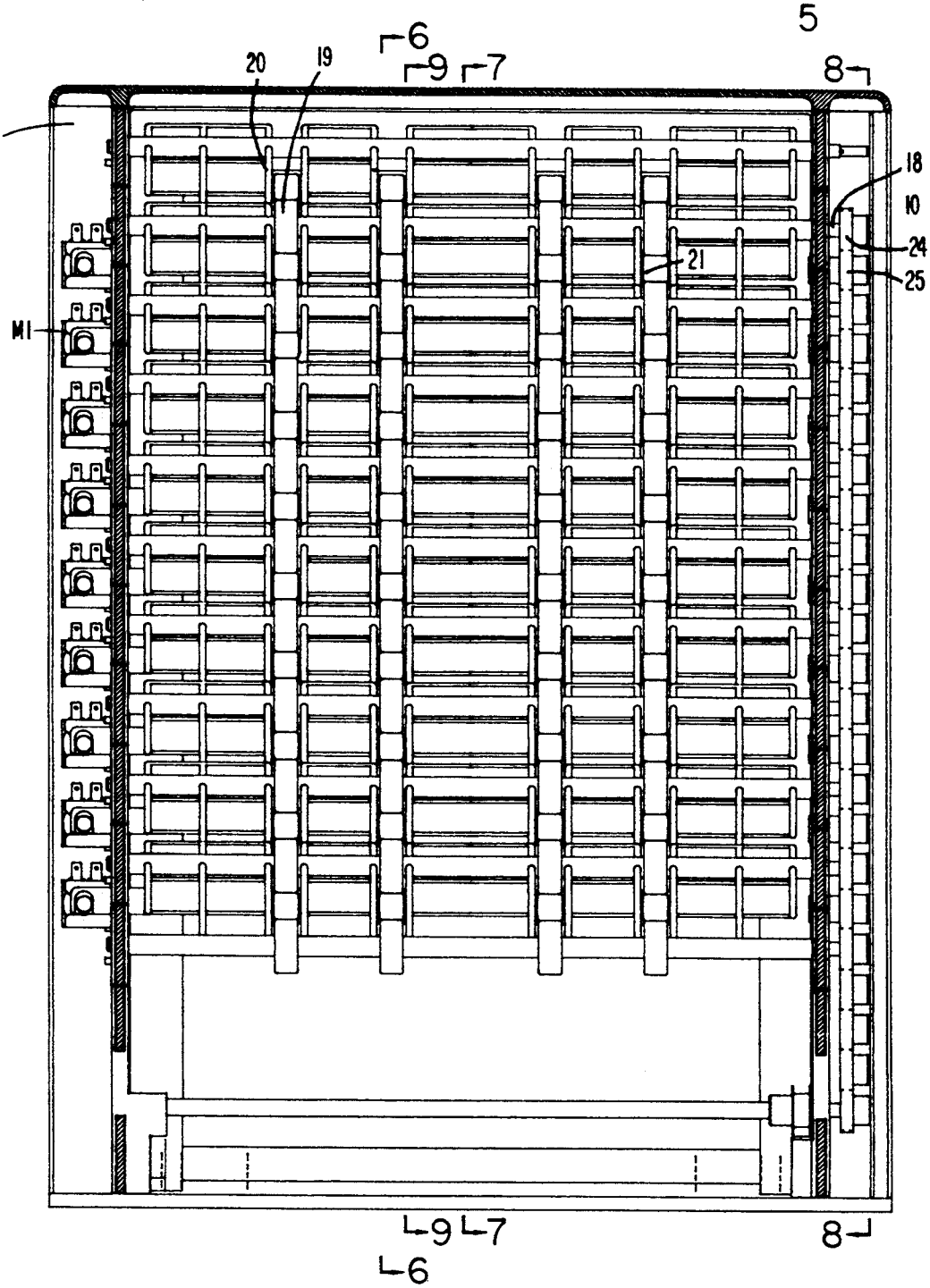
FIG. 4 is a vertical section on the line 4—4 of FIG. 3 showing the assembly of the sheet deflecting section of the sheet feeding mechanism, with the trays removed.
Figure 5:
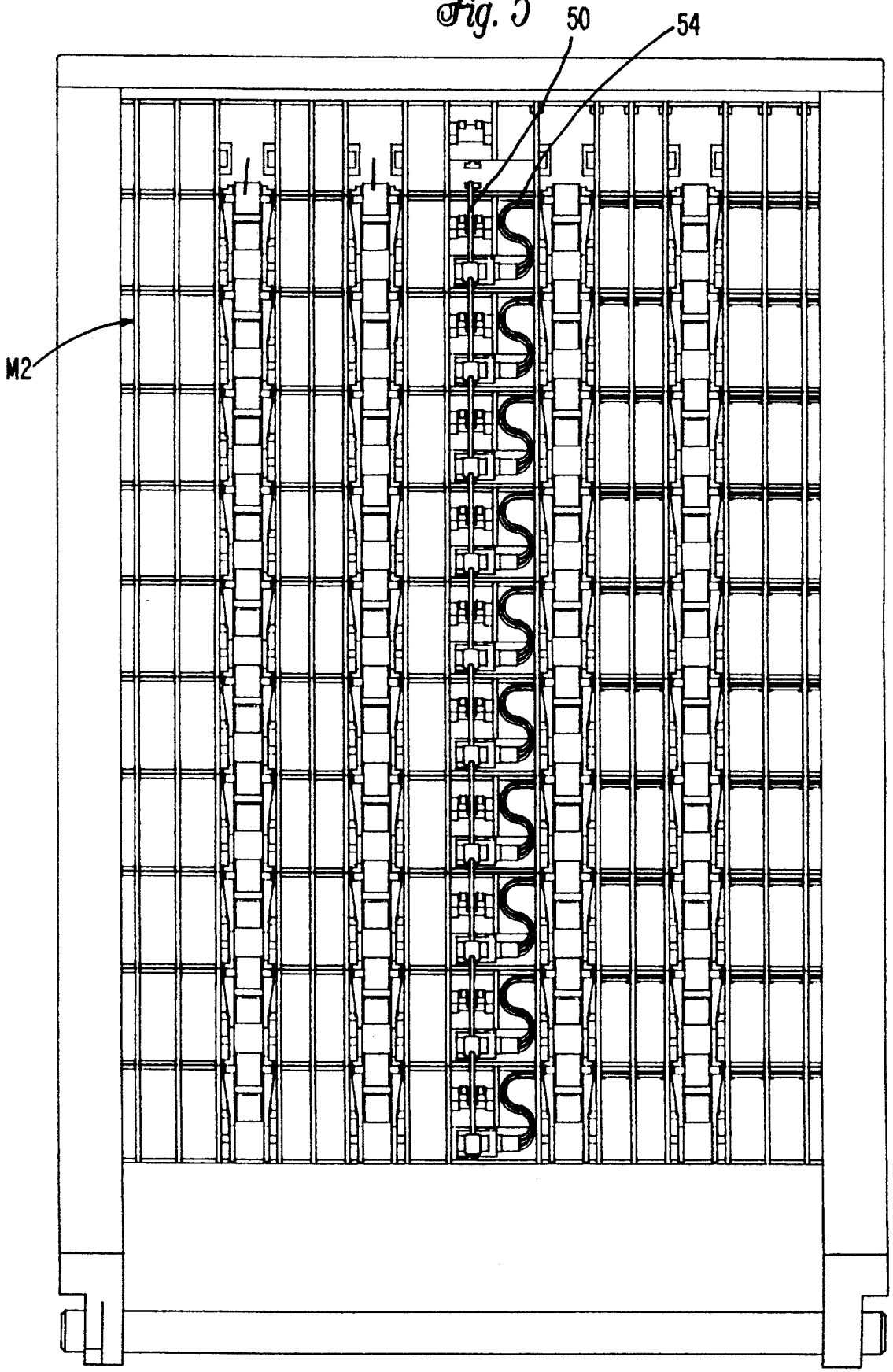
FIG. 5 is a vertical section on the line 5—5 of 3 showing the assembly of the pressure roll mechanism.

Referring to FIGS. 3–5, the tower assembly 10 is illustrated in FIG. 3, and the respective sections 12 and 13 are illustrated in FIGS. 4 and 5 as viewed where they oppose one another at the feed path 15.

Figure 10:
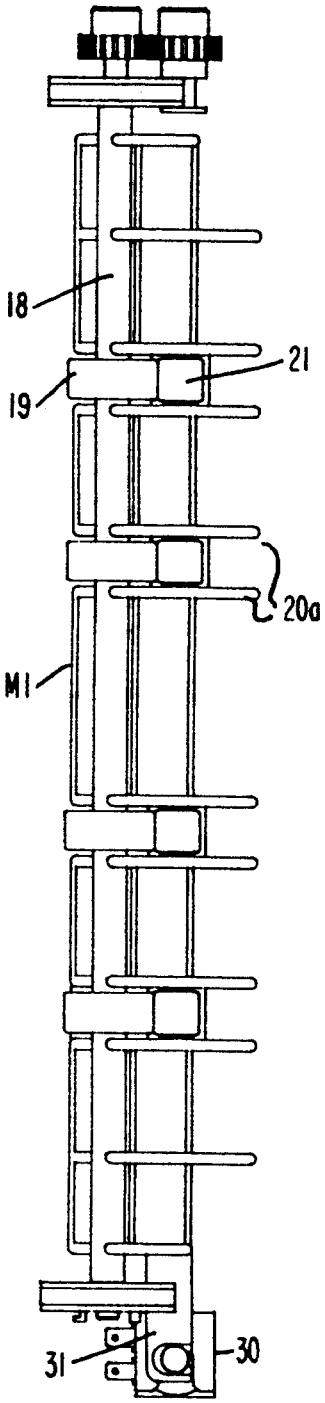
FIG. 10 is a front elevation of a sheet feed module.
Figure 11:
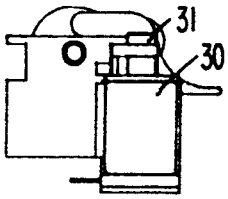
FIG. 11 is an end elevation of the module of FIG. 10.

Referring now to FIGS. 3 and 4, it will be noted that the transport and deflecting section 12 comprises a frame structure 17 in which are stacked a suitable number of modules M1 (one of which is also seen in FIG. 10). Each such module includes an elongated driven shaft 18 on which is mounted a plurality of friction sheet feeding rolls 19. Each shaft 18 also has associated with each feed roll 19 a pivoted gate 20, and each gate 20 rotatably supports a nip roll 21 which is adapted as later described to cooperate with the associated roll 19 to provide a positive drive of a sheet into the tray T.

Figure 8:
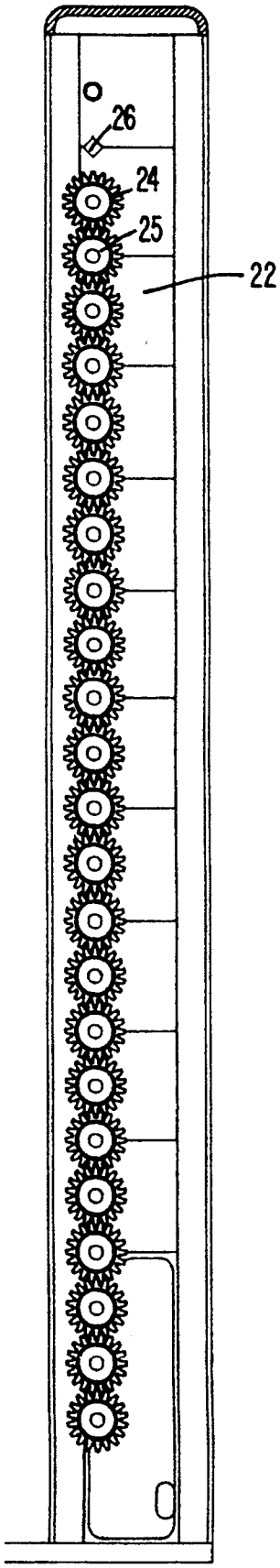
FIG. 8 is a vertical section on the line 8—8 of FIG. 4.

In each module the shaft 18 is rotatably supported at its opposite ends in blocks 22 which are adapted to be vertically slidably inserted into slots 23 in the frame structure 17. The frame structure 17 as best seen in FIG. 3 is formed from opposing posts which are elongated extrusions, the length of which can be determined by the number of modules M1 which are to be utilized in the transport section 12. In order to drive the shaft 18 of each module M1, each shaft, at the right hand end as seen in FIG. 4, has a gear 24 and in mesh with the gears 24 is an idler gear 25 rotatable on a stub shaft adapted to be mounted between adjacent blocks in a recess 26 (one of which is seen in FIG. 8).

When the modules M1 are stacked in the frame 17 with all of the shaft drive gears and idler gears 24 and 25 in mesh, all of the shafts 18 will be driven uni-directionally by a drive shaft 27 and belt 28 at the base of the frame and by an appropriate drive motor (not shown). The gates 20 are supported on a rockable member 29 and at the opposite end of each of the modules from the gearing is a solenoid 30 the armature of which is connected to an extension 31 of the rockable member 29, so that upon energization of the solenoid the gates of the respective modules can be pivoted to a sheet deflecting position as will be later described.

Figure 6A:
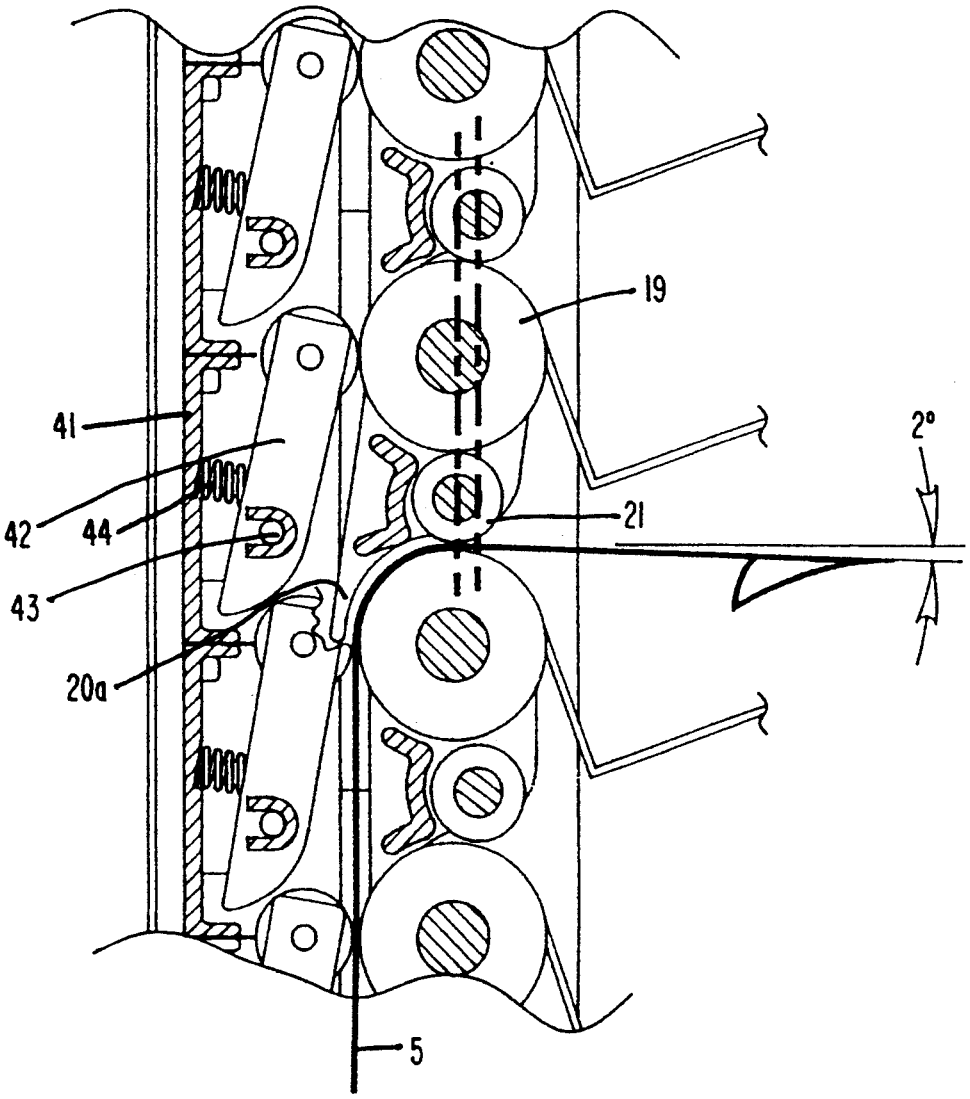
FIG. 6*a* is an enlarged fragmentary section on the line 6—6 of FIG. 4, showing the sheet deflecting position of a gate.
Figure 12:
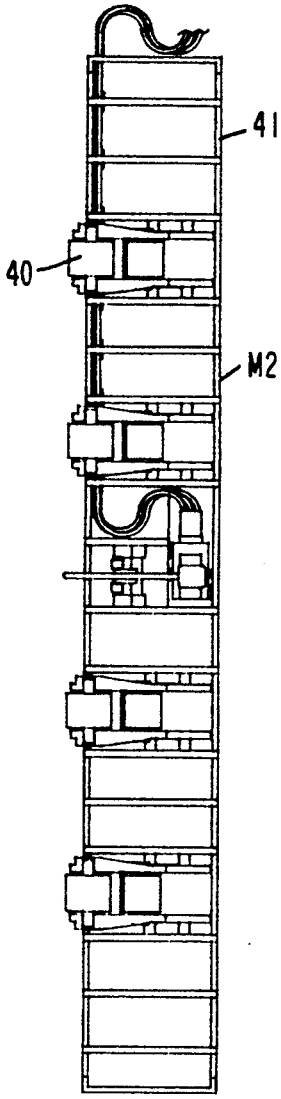
FIG. 12 is a front elevation of a pressure roll and sheet feeding module.
Figure 13:
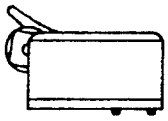
FIG. 13 is an end elevation of the module of FIG. 12.

Referring now to FIGS. 3, 5 and 12 it will be seen that the pressure applying and sheet detecting section 13 is also a modular construction including a suitable number of modules M2. Each module M2 includes a number of pressure applying rolls 40 adapted to apply pressure against the driven rolls 19 of the transport module 10. Each module M2 includes a body 41 having a tongue and groove connection at 42 with a complemental portion of the frame posts 17, whereby a number of modules M2 corresponding to the number of modules M1 can be employed in the respective sections 12 and 13. As best seen in FIG. 6*a*, each pressure roll 40 is mounted upon a support arm 42 pivoted at 43 and biased by a spring 44 in a direction to move the pressure roll 40 against the opposing driven roll 19.

Thus, sheets moving upwardly between the modules are transported between the driven and pressure rolls from tray to tray, unless one of the solenoids is actuated to open one of the gates so that the fingers 20*a* of the gate 20 extend into the sheet path, thereby deflecting the sheet S as seen in FIG. 6*a* towards the associated tray T. It will also be noted with reference to FIG. 6*a* that when the gate 20 is in the sheet deflecting position the nip roll 21, which is normally inactive but is carried by the gate, is moved into opposing relation to the feed roll 19 and therefore, constitutes, at this time, an added pressure roll for carrying the sheet substantially fully into the tray under the influence of a positive drive. It will be noted that upon opening of a gate, as illustrated in FIG. 6*a*, the axis of a nip roll 21 on the opened gate, as the gate swings open, moves relative to its normal position as indicated by the spaced apart center lines.

It will also be noted with reference to FIG. 6*a* that the fingers 20*a* at their sheet engaging sides are arched to deflect the leading edge of the sheet into the nip between driven roll 19 and nip roll 21. In addition, the fingers 20*a* nest in the gate 20 of the next subjacent module M1, thereby enabling the overall height of the assembly to be minimized. On the other hand, when the gates are in the normal position the surfaces which extend along the sheet feed path assist in the provision of smoothly continuous sheet guide surfaces provided by webs or ribs formed in the opposing modules.

Figure 9:
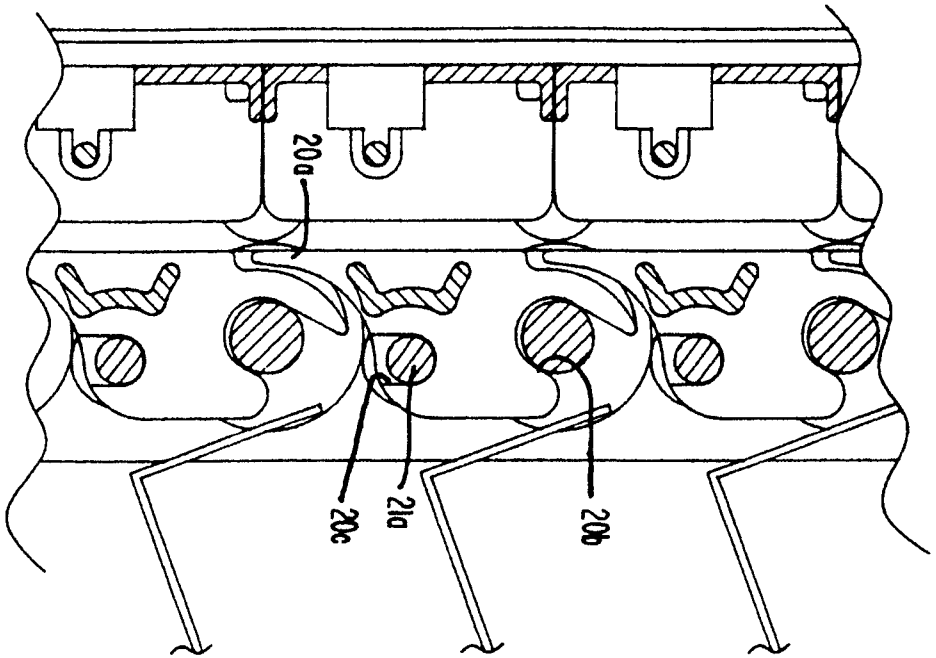
FIG. 9 is a fragmentary enlarged section on the line 9—9 of FIG. 4, showing the nesting finger construction and the assembly of the gate and nip roller components in a module.

As seen in FIG. 9, the modular constructions M1 are such that upon assembly of the modules one on the other, each gate section 20 has a notch 20*b* which opens upwardly for reception of the roller shaft 18. Also each gate section 20 has a downwardly opening notch 20c for reception of the shaft 21a of the nip roller 21, so that upon assembly of a plurality of modules M1, one on the other, the weight of the gate unit applies a downward force on the nip rollers 21 as shaft 21a bottoms in notch 20a, as permitted by the lost motion connection of the gate unit with the shaft.

Figure 14:
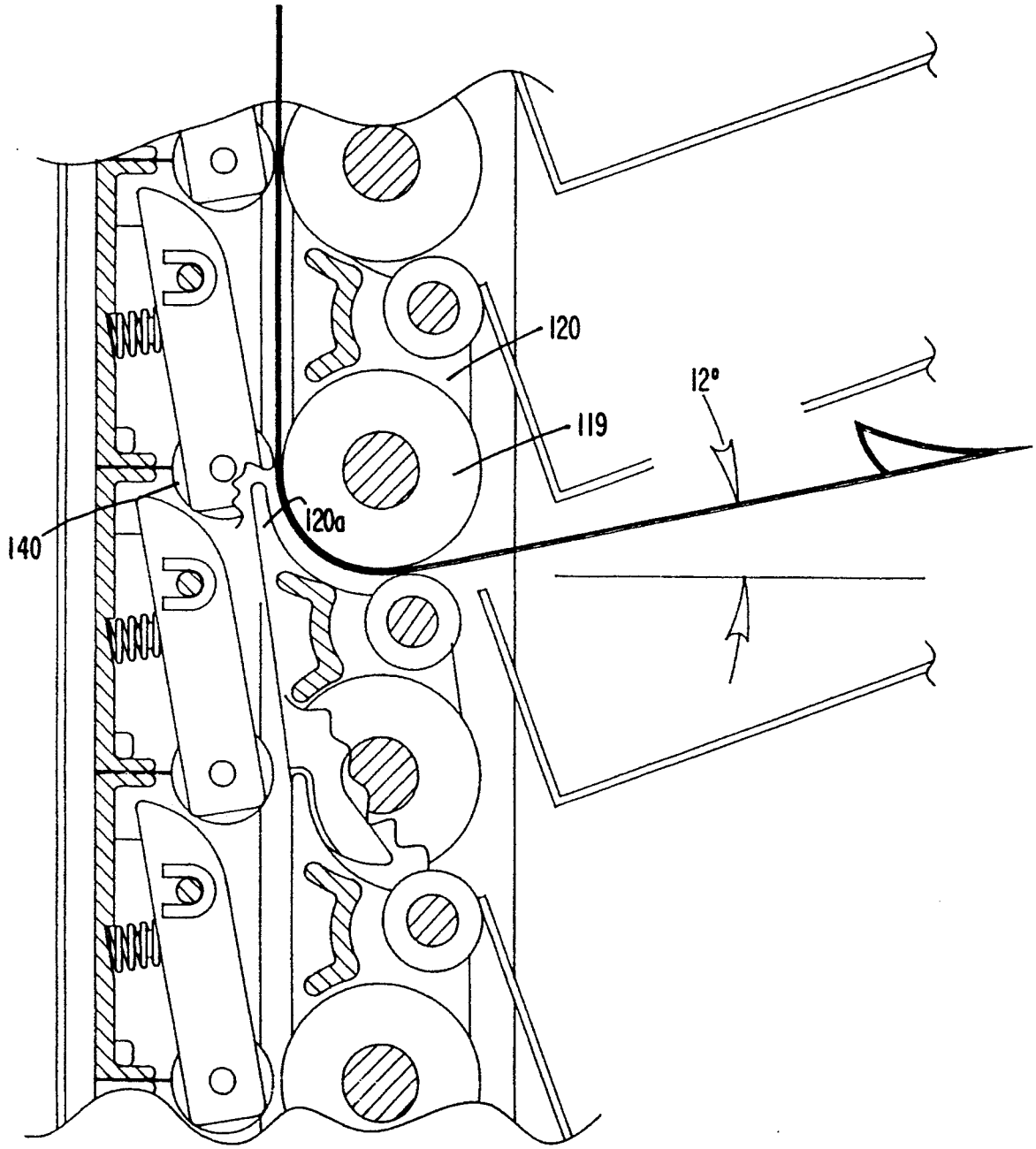
FIG. 14 is a view like FIG. 6*a* but showing a modification for feeding sheets downwardly for deflection into a tray.

In FIG. 14 a modified form of the invention is shown, wherein the sheets may be fed downwardly and deflected into the trays T by gates 120. In this version, the gate is to move the fingers 120a into the path of the sheet S moving downwardly between the driven rolls 119 and pressure rolls 140, and the nip roll on the gate moves upwardly to contact the feed roll 119.

In the automatic collating of sets of copies when multiple copies of an original are made and supplied from a host copier, the gates may be opened sequentially until the selected number of copies have been fed into a similar number of bins. However, when the apparatus is to be used as a mailbox for selective or random deflection into selected trays of jobs or output from different control locations in a network, it becomes necessary to sense the position of sheets in the transport system, so that appropriate control signals may be provided related to the tray into which the sheet is to be displaced and whether one sheet entering one tray has moved sufficiently to permit the feeding of a next sheet. This is particularly necessary when the apparatus is associated with a high speed printer so that control signals for the printer can be generated as a function of sheet position in the receiver.

Therefore, in the pressure applying and sheet sensing section 13, sheet detecting means are provided in each module M2.

Referring to FIGS. 5 and 7, each module has a sheet sensing finger 50 pivotally mounted at 51 and having a switch arm 51 normally extending into the sheet path but adapted to be displaced by the leading edge of a sheet and released upon passage of the trailing edge to activate a switch 53.

Each module also has an electronic cable 54 connected to the switch so that information can be supplied to the control system related to which of the switches in the stack of modules is activated due to the presence of a sheet in transit and which of the gate opening solenoids should be energized, depending upon the destination of the first sheet versus the next sheet.

I claim:

1. In a sheet receiver apparatus comprising a plurality of sheet receiving trays, means for supplying sheets to said trays from a printing machine, including a driven sheet feed roll assembly and a pressure applying assembly in opposing relation to apply sheet feeding pressure to sheets between said assemblies and defining a sheet feed path therebetween: the improvement wherein said driven sheet feed roll assembly includes a plurality of driven feed rolls and normally closed pivotal gates associated with said driven feed rolls spaced along said feed path in the direction of sheet feed, drive shafts for said driven feed rolls extending horizontally, said gates being pivotally supported on said drive shafts and forming a substantially planar guide surface between said driven feed rolls at one side of said feed path, means for pivotally opening said gates to deflect sheets towards a tray from said feed path, and nip rolls carried by said gates and engaging said driven feed rolls between said feed path and said tray to carry the deflected sheet to said tray.

2. Sheet receiver apparatus as defined in claim 1, wherein said gates have fingers which nest with the other gates spaced along said feed path.

3. Sheet receiver apparatus as defined in claim 1, wherein said pressure applying assembly has pressure rolls contacting said driven feed rolls along said feed path upstream of said gates in the direction of sheet movement and said gates have arched surfaces to guide sheets between said driven feed rolls and said nip rolls.

4. Sheet receiver apparatus as defined in claim 1, wherein said pressure applying assembly has pressure rolls contacting said driven feed rolls along said feed path, and said driven feed rolls and gates and pressure rolls respectively being carried in identical modules, and including means mounting said modules in positions one on the other along said feed path.

5. Sheet receiving apparatus as defined in claim 1, including sensing means spaced along said feed path at the locations of the feed rolls and gates to sense the presence and location of a sheet in said feed path.

6. A sheet receiver as defined in claim 1, wherein said driven sheet feed roll assembly and pressure applying assembly extend vertically and said driven feed rolls, gates and nip rolls including a lost motion pivot connection of said gates to the drive shaft for said driven feed rolls enabling the weight of the gates to press the nip roll against the driven feed roll below.

7. Sheet receiver apparatus as defined in claim 1, wherein said pressure applying assembly has pressure rolls contacting said driven feed rolls along said feed path, said driven feed rolls, gates and pressure rolls respectively being carried in identical modules, and including means mounting said modules in positions one on the other along said feed path, said gates having a lost motion pivot connection with said drive shafts enabling the weight of the gates to press the nip rolls against the driven feed rolls below.

8. A sheet receiver as defined in claim 1, including mean interconnecting said driven sheet feed roll assembly and said pressure applying assembly together in operative relation and for separation along said feed path.

9. A module assembly for a sorter having a pressure applying assembly and a modular driven sheet feed roll assembly in opposing relation to define a sheet feed path, said module assembly including end blocks for installation in the sorter frame, a drive shaft extending between said end blocks, means for rotatively driving said drive shaft, a plurality of sheet feeding driven rolls spaced along said drive shaft for rotation therewith, a sheet deflecting gate pivoted on said drive shaft and having arched sheet deflecting fingers extending between said driver rolls, a plurality of sheet feed nip rolls rotatably supported by said gate in alignment with said driven rolls, and means for pivoting said gate on said drive shaft.

10. A module assembly as defined in claim 9, including means providing a lost motion pivotal connection between said drive shaft and said gate permitting free movement of said gate and said nip rolls in a direction away from said drive shaft.

11. A module assembly as defined in claim 9, including means providing a lost motion pivotal connection between said drive shaft and said gate permitting free movement of said gate and said nip rolls in a direction away from said drive shaft for receiving axles of said nip rolls and limiting movement of the nip rolls towards said drive shaft.

* * * * *